United States Patent [19]

Vasalos et al.

[11] 4,440,632

[45] Apr. 3, 1984

[54] CATALYTIC CRACKING WITH REDUCED EMISSION OF NOXIOUS GAS

[75] Inventors: Iacovos A. Vasalos, Thessaloniki, Greece; Eugene G. Wollaston, Naperville, Ill.

[73] Assignee: Standard Oil Company (Indiana), Chicago, Ill.

[21] Appl. No.: 187,612

[22] Filed: Sep. 15, 1980

[51] Int. Cl.[3] ..... C10G 11/18; B01J 37/14

[52] U.S. Cl. ..... 208/113; 208/159; 208/164; 208/121; 502/38

[58] Field of Search ..... 208/113, 120, 164; 252/411 S, 417, 419

[56] References Cited

U.S. PATENT DOCUMENTS

| | | | |
|---|---|---|---|
| 3,679,576 | 7/1972 | McDonald | 208/164 |
| 3,846,280 | 11/1974 | Owen et al. | 208/120 |
| 4,036,779 | 7/1977 | Schatz et al. | 208/120 |
| 4,057,397 | 11/1977 | Gross et al. | 208/120 |
| 4,146,463 | 3/1979 | Radford et al. | 208/164 |
| 4,174,272 | 11/1979 | Schwartz | 208/113 |
| 4,259,175 | 3/1981 | McArthur | 208/113 |
| 4,260,475 | 4/1981 | Scott | 208/113 |
| 4,274,942 | 6/1981 | Bartholic et al. | 208/113 |
| 4,276,150 | 6/1981 | McHenry, Jr. | 208/120 |
| 4,283,273 | 8/1981 | Owen | 208/113 |

*Primary Examiner*—Delbert E. Gantz
*Assistant Examiner*—O. Chaudhuri
*Attorney, Agent, or Firm*—Richard A. Kretchmer; William T. McClain; William H. Magidson

[57] ABSTRACT

Emissions of sulfur oxides from the regenerator of a fluidized catalytic cracking unit are reduced by selectively removing a portion of the sulfur from sulfur-containing coke deposits on deactivated cracking catalyst. This is accomplished by reaction of these deposits with limited amounts of molecular oxygen in a stripping zone at a temperature in the range from about 550° to about 700° C. Effluent gas from the striping zone is combined with the cracked hydrocarbon products.

11 Claims, 2 Drawing Figures

CATALYTIC CRACKING WITH REDUCED EMISSION OF NOXIOUS GAS

BACKGROUND OF THE INVENTION

1. Field of the Invention

This invention relates to a process for reducing the emissions of sulfur oxides from the regenerator of a catalytic cracking unit. More particularly, the invention relates to a selective removal of a portion of the sulfur from sulfur-containing coke deposits on deactivated cracking catalyst by reaction of these deposits with limited amounts of molecular oxygen in a stripping zone.

2. Description of the Prior Art

A major industrial problem involves the development of efficient methods for reducing the concentration of air pollutants, such as sulfur oxides, in waste gas streams which result from the processing and combustion of carbonaceous fuels which contain sulfur. The discharge of these waste gas streams into the atmosphere is environmentally undesirable at the sulfur oxide concentrations which are frequently encountered in conventional operations. The regeneration of cracking catalyst which has been deactivated by coke deposits in the catalytic cracking of sulfur-containing hydrocarbon feedstocks is a typical example of a process which can result in a waste gas stream containing relatively high levels of sulfur oxides.

Catalytic cracking of heavy petroleum fractions is one of the major refining operations employed in the conversion of crude petroleum oils to useful products such as the fuels utilized by internal combustion engines. In fluidized catalytic cracking processes, high molecular weight hydrocarbon liquids and vapors are contacted with hot, finely-divided, solid catalyst particles either in a fluidized bed reactor or in an elongated transfer line reactor, and maintained at an elevated temperature in a fluidized or dispersed state for a period of time sufficient to effect the desired degree of cracking to lower molecular weight hydrocarbons of the kind typically present in motor gasoline and distillate fuels.

In the catalytic cracking of hydrocarbons, some nonvolatile carbonaceous material or coke is deposited on the catalyst particles. Coke comprises highly condensed aromatic hydrocarbons and generally contains from about 4 to about 10 percent hydrogen. When the hydrocarbon feedstock contains organic sulfur compounds, the coke also contains sulfur. As coke accumulates on the cracking catalyst, the activity of the catalyst for cracking and the selectivity of the catalyst for producing gasoline blending stocks diminishes.

Catalyst which has become substantially deactivated through the deposit of coke is continuously withdrawn from the reaction zone. The catalyst particles are then reactivated to essentially their original capabilities by burning the coke deposits from the catalyst surfaces with an oxygen-containing gas such as air in a regeneration zone. Regenerated catalyst is continuously returned to the reaction zone to repeat the cycle.

When sulfur-containing feedstocks, such as petroleum hydrocarbons containing organic sulfur compounds, are utilized in a catalytic cracking process, the coke deposited on the catalyst contains sulfur. During regeneration of the coked deactivated catalyst, the coke is burned from the catalyst surfaces which results in the conversion of the sulfur to sulfur dioxide together with small amounts of sulfur trioxide. This burning can be represented, in a simplified manner, as the oxidation of sulfur according to the following equations:

$$S\ (\text{in coke}) + O_2 \rightarrow SO_2 \quad (1)$$

$$2SO_2 + O_2 \rightarrow 2SO_3 \quad (2)$$

One approach to the removal of sulfur oxides from the waste gas produced during the regeneration of deactivated cracking catalyst involves scrubbing the gas downstream of the regenerator vessel with an inexpensive alkaline material, such as lime or limestone, which reacts chemically with the sulfur oxides to give a nonvolatile product which is discarded. Unfortunately, this approach requires a large and continual supply of alkaline scrubbing material, and the resulting reaction products can create a solid waste disposal problem of substantial magnitude. In addition, this approach requires complex and expensive auxiliary equipment.

A second approach to the control of sulfur oxide emissions involves the use of sulfur oxide absorbents which can be regenerated either thermally or chemically. An example of this approach to the removal of sulfur oxides from the regeneration zone effluent gas stream in a cyclic, fluidized, catalytic cracking process is set forth in U.S. Pat. No. 3,835,031 to Bertolacini et al. This patent discloses the use of a zeolite-type cracking catalyst which is modified by impregnation with one or more metal compounds of Group IIA of the Periodic Table, followed by calcination, to provide from about 0.25 to about 5.0 weight percent of Group IIA metal or metals as an oxide or oxides. The metal oxide or oxides react with sulfur oxides in the regeneration zone to form nonvolatile inorganic sulfur compounds. These nonvolatile inorganic sulfur compounds are then converted to the metal oxide or oxides and hydrogen sulfide upon exposure to hydrocarbons and steam in the reaction and steam stripping zones of the process unit. The resulting hydrogen sulfide is disposed of in equipment which is conventionally associated with a fluidized catalytic cracking process unit. Belgian Pat. No. 849,637 is also directed to a process wherein a Group IIA metal or metals are circulated through a cyclic fluidized catalytic cracking process with the cracking catalyst in order to reduce the sulfur oxide emissions resulting from regeneration of deactivated catalyst.

U.S. Pat. No. 4,153,534 to Vasalos discloses a process similar to that set forth in U.S. Pat. No. 3,835,031, which involves the removal of sulfur oxides from the regeneration zone flue gas of a cyclic, fluidized, catalytic cracking unit through the use of a zeolite-type cracking catalyst in combination with a regenerable sulfur oxide absorbent which absorbs sulfur oxides in the regeneration zone and releases the absorbed sulfur oxides as a sulfur-containing gas in the reaction and steam stripping zones of the process unit. The sulfur oxide absorbent comprises at least one free or combined element selected from the group consisting of sodium, scandium, titanium, chromium, molybdenum, manganese, cobalt, nickel, antimony, copper, zinc, cadmium, the rare earth metals and lead.

U.S. patent application Ser. No. 91,469 by McHenry (now U.S. Pat. No. 4,276,150) discloses a third approach to the reduction of sulfur oxide emissions from the regeneration of deactivated cracking catalyst. This application is directed to a process for the fluidized catalytic cracking of a sulfur-containing heavy feedstock which contains at least a substantial fraction which cannot be vaporized at atmospheric pressure without extensive decomposition such as residuum and whole crude. These low quality feedstocks result in the formation of large quantities of sulfur-containing coke during catalytic cracking which, ordinarily, are substantially in excess of the amount of coke which must be burned in a conventional regeneration zone to provide process heat. McHenry discloses that the coke which is in excess of that required for process heat balance requirements can be removed and converted to a valuable product by gasification prior to subjecting the catalyst to conventional regeneration. The sulfur-containing coke deposits are gasified with oxygen and steam at a temperature of from about 593° to about 1204° C. in a stripper-gasifier to produce a low BTU gas stream comprising hydrogen sulfide, methane, carbon monoxide, hydrogen and carbon dioxide. The resulting low BTU gas is processed separately from the catalytic cracking products and can be passed to an amine absorption unit of conventional design for removal of hydrogen sulfide and traces of sulfur dioxide.

The process which is described by the McHenry application, however, fails to either teach or suggest that the sulfur content of the coke deposits on deactivated cracking catalyst can be selectively removed by reaction with small amounts of molecular oxygen. The McHenry application also fails to suggest the possibility or desirability of contacting the sulfur-containing coke deposits on deactivated catalyst with small amounts of oxygen in a stripping zone and combining the resulting stripping zone effluent with cracked hydrocarbon products from the reaction zone for processing in a common product recovery zone. Further, the McHenry application fails to suggest the desirability of gasifying any portion of the coke deposits except when coke production is in excess of that required for heat balance requirements in the cracking process.

Canadian Pat. No. 875,528 discloses a method for regenerating a cracking catalyst which involves reacting the coke deposits on deactivated catalyst with a regeneration gas which consists of oxygen and at least one member selected from the group consisting of steam and carbon dioxide at a temperature in the range of about 566° to 816° C. to form an effluent containing carbon monoxide. This effluent is then passed to a reaction zone wherein the carbon monoxide is combined with steam in a water gas shift reaction to produce hydrogen and carbon dioxide. It is further disclosed that the resulting product gases can be treated by conventional techniques to remove carbon dioxide and hydrogen sulfide. The Canadian Patent, however, requires a complete gasification of the coke deposits and also fails to teach or suggest that the sulfur content of the coke deposits on deactivated catalyst can be selectively removed by reaction with small amounts of molecular oxygen. Further, the Canadian Patent contains no suggestion that the gasification products could be combined with cracked hydrocarbon products for processing in a common product recovery zone.

U.S. Pat. No. 2,398,739 to Greensfelder et al. discloses a multi-staged fluidized process for the regeneration of deactivated cracking catalyst with an oxygen-containing gas. This patent teaches the partial regeneration of spent cracking catalyst in a low temperature regenerator at a temperature between about 538° and 593° C. Partially regenerated catalyst is then passed to a high temperature regenerator wherein regeneration is completed at a temperature of about 677° C. Similarly, published U.K. Patent Application No. 2,001,545 discloses a two-stage regeneration process wherein there is no major evolution of heat from either regeneration stage. These two references, however, contain no teaching or suggestion that the sulfur content of the coke deposits on deactivated cracking catalyst can be selectively removed by reaction with small amounts of oxygen. Indeed, these references contain no mention of sulfur or sulfur oxides in any context. In addition, they fail to suggest the possibility or desirability of contacting coke deposits on deactivated catalyst with small amounts of oxygen in a stripping zone and combining the resulting stripping zone effluent with cracked hydrocarbon products from the reaction zone for processing in a common product recovery zone.

SUMMARY OF THE INVENTION

This invention is directed to a process for the fluidized catalytic cracking of a hydrocarbon feedstock containing organic sulfur compounds which comprises: (a) cracking said feedstock in a reaction zone through contact with a particulate cracking catalyst; (b) separating cracking products from cracking catalyst which is deactivated by sulfur-containing coke deposits and passing said deactivated cracking catalyst to a stripping zone; (c) contacting the deactivated cracking catalyst with an oxygen-containing gas in said stripping zone at a temperature in the range from about 550° to about 700° C. and reacting the oxygen with said sulfur-containing coke deposits to form products which include sulfur-containing gases, wherein the amount of oxygen introduced into said stripping zone is effective to remove at least about 10 weight percent of the sulfur content and less than about 30 weight percent of the carbon content of said sulfur-containing coke deposits, and wherein said weight percent of the sulfur content removed is greater than said weight percent of the carbon content removed; (d) withdrawing an effluent gas from the stripping zone and combining said stripping zone effluent gas with said cracking products; (e) withdrawing from the stripping zone cracking catalyst which is deactivated by modified coke deposits having a reduced sulfur content and passing said catalyst from the stripping zone to a regeneration zone; (f) removing said modified coke deposits from the deactivated cracking catalyst in said regeneration zone by burning with an oxygen-containing regeneration gas, thereby heating and regenerating the cracking catalyst; and (g) withdrawing regenerated catalyst from the regeneration zone and passing said regenerated catalyst to the reaction zone.

It has been discovered that the sulfur content of coke deposits on deactivated cracking catalyst can be selectively removed by reaction of these deposits with limited amounts of molecular oxygen. Accordingly, it is an object of this invention to provide a process for the selective removal of sulfur from coke deposits on deactivated cracking catalyst.

Another object of this invention is to provide an improved method for reducing sulfur oxide emissions from the regenerator of a fluidized catalytic cracking unit.

Other objects, aspects and advantages of the invention will be readily apparent from the following detailed description and claims.

DETAILED DESCRIPTION OF THE INVENTION

Figure 1:
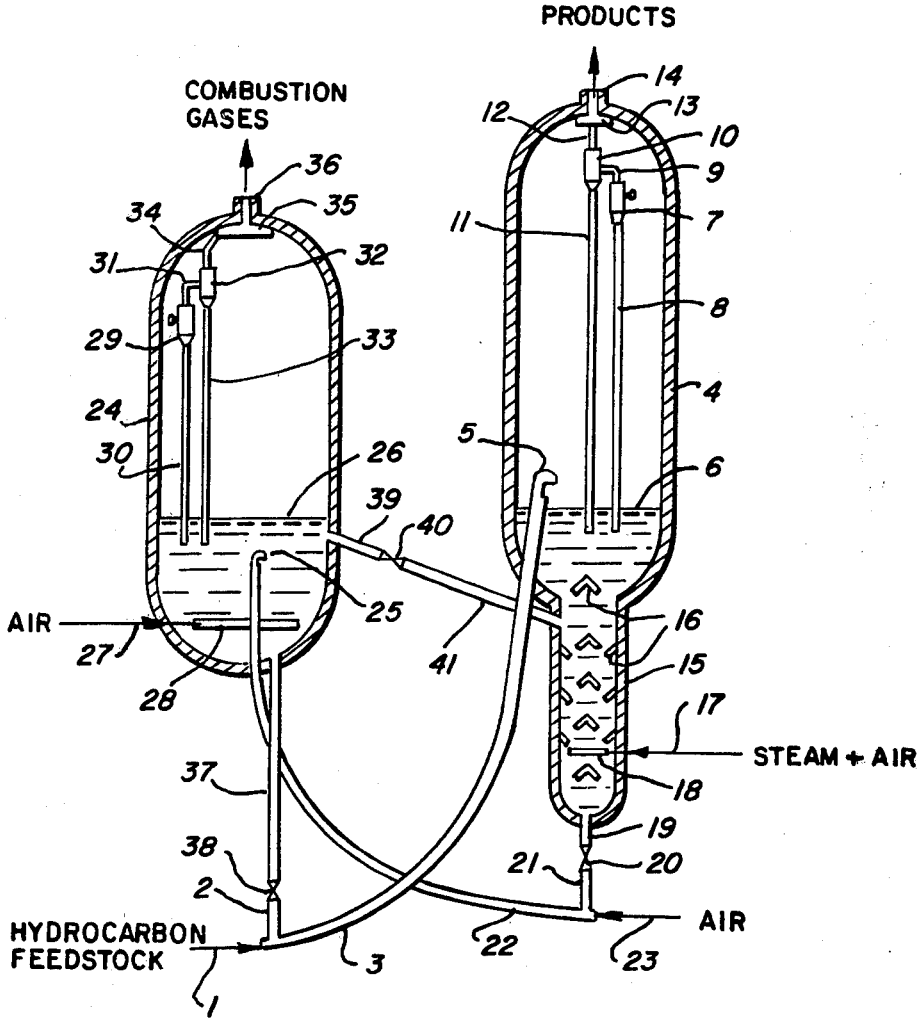
FIG. 1 of the drawings is a schematic representation of one embodiment of the present invention.

It has been discovered that emissions of sulfur oxides from the regeneration zone of a fluidized catalytic cracking unit can be reduced by contacting deactivated cracking catalyst with small amounts of molecular oxygen in a stripping zone. The sulfur-containing coke deposits on deactivated cracking catalyst undergo a partial gasification in the stripping zone upon contact with the oxygen, and this results in a preferential removal of the hydrogen and sulfur content of the coke. The resulting catalyst which is discharged from the stripping zone carries a modified coke deposit which has a reduced sulfur content. As a consequence, the combustion of this modified coke in the regeneration zone affords a reduced amount of sulfur oxides.

The sulfur-containing effluent gas from the stripping zone, which comprises hydrogen sulfide, is combined with the hydrocarbon cracking products from the reaction zone. This combination is then processed in the conventional product recovery facilities which are associated with the catalytic cracking unit. Although the invention disclosed herein is not to be so limited, the catalytic cracking products are typically separated in a fractionator and the low molecular weight products are passed from the fractionator to a vapor recovery unit wherein hydrogen sulfide is removed by scrubbing in one or more amine absorption towers. The most commonly used amines for hydrogen sulfide removal are monoethanolamine and diethanolamine. The hydrogen sulfide is subsequently removed from the amine scrubbing solution and can be converted to elemental sulfur, for example, by means of the Claus process.

In the practice of this invention, molecular oxygen is introduced into the stripping zone in an amount which is effective to remove at least about 10 weight percent, preferably at least about 20 weight percent, and more preferably at least about 30 weight percent of the sulfur content and less than about 30 weight percent of the carbon content of the sulfur-containing coke deposits on the deactivated catalyst. Although the chemical composition of the coke deposits can vary significantly, this will generally correspond to less than about 23 percent of the stoichiometric amount of oxygen required to completely convert the coke to carbon dioxide, steam and sulfur dioxide. It will be understood, of course, that said weight percent of the sulfur content removed is greater than said weight percent of the carbon content removed. During the practice of this invention, it is frequently possible to remove more than about 40 weight percent of the sulfur content of the coke deposits in the stripping zone while simultaneously removing less than about 10 weight percent of the carbon content. In a preferred embodiment of the invention, molecular oxygen is introduced into the stripping zone in an amount which is effective to remove at least about 10 weight percent of the sulfur content and less than about 10 weight percent of the carbon content of the sulfur-containing coke deposits on the deactivated catalyst. In this preferred embodiment, the amount of oxygen employed will generally correspond to less than about 8 percent of the stoichiometric amount required to completely convert the coke to carbon dioxide, steam and sulfur dioxide.

Although the invention which is disclosed herein is not to be so limited, it is believed that the small amounts of oxygen which are introduced into the stripping zone serve to preferentially convert the hydrogen and sulfur content of the coke deposits to steam and sulfur dioxide respectively. In addition, a small portion of the carbon content of the coke deposits is converted to a mixture of carbon monoxide and carbon dioxide. The carbon monoxide then undergoes a water-gas shift reaction with steam to produce hydrogen according to equation (3), and the resulting hydrogen converts the sulfur dioxide to hydrogen sulfide according to equation (4).

$$CO+H_2O \rightarrow CO_2+H_2 \quad (3)$$

$$SO_2+3H_2 \rightarrow H_2S+2H_2O \quad (4)$$

Finally, any residual sulfur dioxide in the stripping zone effluent undergoes conversion to hydrogen sulfide upon contact with the cracked hydrocarbon products from the reaction zone which include molecular hydrogen.

Although not essential, the coked catalyst is preferably contacted with oxygen in a countercurrent manner within the stripping zone. In this preferred embodiment, molecular oxygen is introduced near the bottom of the stripping zone and is passed upwardly through the deactivated catalyst particles which are passed downwardly through the stripping zone. As a consequence of this countercurrent contacting, the reaction of coke with oxygen takes place primarily near the bottom of the stripping zone, and the resulting gasification products strip any residual volatile material and entrained hydrocarbon vapors from the spent catalyst as it enters and begins its downward passage through the stripping zone. In this embodiment, it is believed that the sulfur dioxide initially produced by reaction of the coke with oxygen is substantially converted to hydrogen sulfide during upward passage through the stripping zone.

The molecular oxygen which is introduced into the stripping zone can contain one or more diluent gases such as nitrogen, steam, carbon dioxide and the like. Since air is conveniently employed as a source of molecular oxygen, a major portion of the diluent gas can be nitrogen. However, a preferred embodiment of the invention involves the use of substantially undiluted molecular oxygen. The use of substantially undiluted or pure oxygen is advantageous in that the reaction of oxygen with coke in the stripping zone will be faster in the absence of a diluent. In addition, the presence of significant amounts of a diluent gas, such as nitrogen, will place an undesirable loading on the downstream product recovery system since the stripping zone effluent gas is combined with the cracking products before passing to this system. Although the invention is not to be so limited, catalytic cracking products are conventionally separated in a fractionator and the low molecular weight products or wet gas is passed from the fractionator to a vapor recovery unit for further separation. As a first step in a conventional vapor recovery unit, the wet gas is usually compressed. Consequently, the presence of a diluent in the oxygen which is delivered to the stripping zone will serve to increase the wet gas volume and cause an unnecessary and usually undesirable increase in the loading on the wet gas compressor.

In another embodiment of the invention, both steam and oxygen are introduced into the stripping zone. The steam can be introduced into the stripping zone separately from the oxygen or can be mixed with the oxygen as a diluent. In this embodiment, the mole ratio of steam to oxygen is desirably in the range from about 0.1/1 to about 5/1. The introduction of both steam and oxygen into the stripping zone is advantageous since the steam serves to promote the formation of molecular hydrogen by way of the water-gas shift reaction which is set forth as equation (3) above. In addition, the steam can also react with carbon in the coke on deactivated catalyst to form molecular hydrogen according to equation (5).

$$C\ (\text{in coke}) + H_2O \rightarrow CO + H_2 \quad (5)$$

The formation of this molecular hydrogen is desirable since it serves to promote the conversion of sulfur dioxide to hydrogen sulfide according to equation (4). It will be appreciated, of course, that the conversion of the sulfur dioxide produced in the stripping zone to hydrogen sulfide is desirable since sulfur dioxide irreversibly degrades the amines, such as monoethanolamine and diethanolamine, which are conventionally used to scrub hydrogen sulfide from the catalytic cracking products.

In another embodiment of the invention, carbon monoxide is introduced into the stripping zone in addition to the molecular oxygen. The carbon monoxide can be mixed with one or more diluent gases such as nitrogen, steam, carbon dioxide and the like. Preferably, the carbon monoxide is introduced into the stripping zone separately from the molecular oxygen. it will be appreciated, of course, that explosive mixtures of carbon monoxide and oxygen are not employed in the stripping zone. The introduction of carbon monoxide serves to promote the formation of hydrogen by way of the water-gas shift reaction which is set forth in equation (3) and this, in turn, promotes the conversion of sulfur dioxide to hydrogen sulfide according to equation (4). Since many conventional techniques for the regeneration of cracking catalyst result in a regeneration zone effluent gas which contains up to about 7 or 8 mole percent carbon monoxide, such an effluent gas can serve as a convenient source of carbon monoxide.

The stripping zone is maintained at a temperature in the range from about 550° to about 700° C. Further, the stripping zone is also maintained at a higher temperature, desirably at least about 30° C. higher, than that in the reaction zone. In a preferred embodiment of the invention, a suitable temperature in the stripping zone is maintained and precisely controlled by mixing a stream of hot regenerated cracking catalyst with the deactivated cracking catalyst in the stripping zone. The recycle ratio in the stripping zone of hot regenerated cracking catalyst to deactivated cracking catalyst is desirably within the range from about 0.05 to about 1.0. Deactivated catalyst passes from the reaction zone to the stripping zone at a temperature which is typically in the range from about 450° to about 540° C. Such a temperature, however, is usually not adequate to promote a sufficiently rapid reaction in the stripping zone between the coke deposits and the limited amounts of oxygen which are employed in the practice of this invention. In addition, the exothermic reaction of coke deposits in the stripping zone with the limited amount of oxygen which is employed in the practice of this invention is usually insufficient to maintain a satisfactory stripping zone temperature without the input of additional heat. The recycle of hot regenerated catalyst from the regeneration zone to the stripping zone serves to provide an easily controlled and efficient input of additional heat to maintain the stripping zone at a suitable temperature.

In another embodiment of the invention, a suitable temperature in the stripping zone is maintained and controlled by passing hot effluent gas from the regeneration zone into the stripping zone in a quantity which is effective for this purpose. The hot regeneration zone effluent gas which is passed into the stripping zone according to this embodiment will typically contain steam, carbon dioxide, nitrogen, small amounts of oxygen, and may or may not contain significant amounts of carbon monoxide depending on the precise process conditions employed within the regeneration zone. In effect, this embodiment involves the maintenance of a satisfactory stripping zone temperature by mixing the stripping zone oxygen with a hot diluent gas. It will be appreciated, of course, that the molecular oxygen which is used in the stripping zone can be introduced into the stripping zone separately from the hot regeneration zone effluent gas or the two can be mixed prior to their introduction into the stripping zone. This embodiment is not usually preferred, however, since the hot regeneration zone gas passed into the stripping zone serves to increase the volume of the stripping zone effluent and, consequently, places an increased and usually undesirable loading on the downstream product recovery system since the stripping zone effluent gas is combined with the cracking products before passing to this system.

In a further embodiment of the invention, a suitable temperature in the stripping zone is maintained and controlled by passing both a stream of hot regenerated catalyst and a stream of hot effluent gas from the regeneration zone into the stripping zone in amounts which are effective for this purpose.

In the practice of this invention, the stripping zone effluent gas is combined with the hydrocarbon cracking products from the reaction zone. This is highly advantageous since the product recovery system which is conventionally associated with a fluidized catalytic cracking unit can also be utilized to process the stripping zone effluent gas and remove the hydrogen sulfide which will be present. As a consequence, it is unnecessary to construct and operate a separate gas processing system to remove hydrogen sulfide from the stripping zone effluent gas and otherwise handle this gas stream. In addition, the catalytic cracking of a hydrocarbon feedstock results in the formation of significant amounts of hydrogen. Typically, hydrogen represents about 0.05 weight percent of the product from the catalytic cracking of a gas oil. Upon combination of the stripping zone effluent gas with the hydrocarbon cracking products, this hydrogen serves to effect a substantially complete conversion of any sulfur dioxide in the stripping zone effluent gas to hydrogen sulfide. This is important, of course, since sulfur dioxide irreversibly degrades the amines, such a monoethanolamine and diethanolamine, which are conventionally used to scrub hydrogen sulfide from a gas stream.

Since the water-gas shift reaction, equation (3), can be promoted catalytically, a preferred embodiment of the invention involves circulating such a catalytic material through the catalytic cracking process cycle. The water-gas shift catalyst can be incorporated into the particles of cracking catalyst. Alternatively, the particles of cracking catalyst can be physically mixed with a separate fluidizable particulate solid which comprises the shift catalyst. The precise nature of the shift catalyst is not critical, and the amount of shift catalyst, calculated as the component metal or metals, is desirably from about 0.01 to about 10 weight percent and preferably from about 0.05 to about 5 weight percent with respect to the cracking catalyst and any admixed solids including the shift catalyst. Suitable water-gas shift catalysts include, but are not limited to, $Fe_2O_3$, $Cr_2O_3$, MgO, NiO, CuO, $Cu_2O$, $Na_2CO_3$, $K_2CO_3$, $Li_2CO_3$, $Cs_2CO_3$ and mixtures thereof. Iron oxide-chromium oxide catalysts are conventionally used in promoting the water-gas shift reaction, equation (3), and can advantageously be used in the practice of the present invention. These conventional iron oxide-chromium oxide catalysts generally contain a major amount of iron oxide, for example about 95 weight percent, and a minor amount of chromium oxide, for example about 5 weight percent. A shift catalyst comprising magnesium oxide can be advantageously employed if the stripping zone is operated at a relatively low temperature. The MgO absorbs carbon dioxide in the stripping zone and, as a consequence, the shift reaction can go to completion. The resulting $MgCO_3$ then decomposes back to MgO with the release of carbon dioxide upon circulation to the regeneration zone, which is maintained at a higher temperature than the stripping zone.

In those embodiments of the invention wherein a water-gas shift catalyst is employed, the shift catalyst is desirably incorporated into or deposited onto a support since this permits a more efficient contacting of the catalytic material with the gases in the stripping zone and also provides control over the attrition properties of the shift catalyst through proper selection of the support. It will be appreciated that the particles which contain the water-gas shift catalyst should be sufficiently strong that they are not subject to excessive attrition and degradation during fluidization. The average size of the particles will be desirably in the range from about 20 microns or less to about 150 microns, and preferably less than about 50 microns. Suitable supports include, but are not limited to, amorphous cracking catalysts, zeolite-type cracking catalysts, silica, alumina, mixtures of silica and alumina, natural and treated clays, kieselguhr, diatomaceous earth, kaolin and mullite. Desirably, the support is porous and has a surface area, including the area of the pores open to the surface, of at least about 10, preferably at least about 50, and most preferably at least about 100 square meters per gram.

The metal or metals of the water-gas shift catalyst can be combined with a support either during or after preparation of the support. One method consists of impregnating a suitable support with an aqueous or organic solution or dispersion of a suitable compound or compounds of the metal or metals of the shift catalyst. Suitable compounds for use in impregnating the support include but are not limited to oxides, acetates, nitrates, hydroxides, bicarbonates and carbonates. The impregnation can be carried out in any manner which will not destroy the structure of the support. After drying, the composite can be calcined, if desired. Alternatively, a suitable compound or compounds of the metal of metals of the shift catalyst, for example an oxide or hydroxide of said metal or metals, can be combined with a support precursor such as silica gel, silica-alumina gel, or alumina gel prior to spray drying or other physical formation process. Subsequent drying and, if desired, calcination then affords the supported shift catalyst.

Although the metal or metals of the water-gas shift catalyst can be combined with a support before introduction into the catalytic cracking process cycle, it is also advantageous to introduce a suitable compound or compounds of the metal or metals into the cracking process cycle and thereby achieve an in situ incorporation onto a support which comprises cracking catalyst. Such compound or compounds can be introduced in solution or dispersion form and in solid, liquid or gaseous state at any stage of the cracking process cycle so that wide distribution in the circulating catalyst is achieved. For example, such compound or compounds can be admixed either with the feedstock or fluidizing gas in the reaction zone; with the regeneration gas, torch oil or spray water in the regeneration zone; or can be introduced as a separate stream. If the compound or compounds are to be introduced as a separate stream, this can be accomplished by introducing the compound or compounds in the form of a solution or dispersion in either water or an organic liquid. Suitable organic liquids include but are not limited to alcohols of from 1 to 5 carbon atoms, benzene, toluene, xylene, ethyl acetate and tetrahydrofuran. Suitable compounds for in situ incorporation include but are not limited to oxides, acetates, nitrates, hydroxides, bicarbonates and carbonates.

FIG. 1 of the drawings is illustrative of one embodiment of the invention involving the introduction of both oxygen and steam into the stripping zone. A hydrocarbon feedstock which contains organic sulfur compounds is passed through line 1 and is contacted with hot regenerated catalyst from line 2 in the inlet portion of transfer line reactor 3. The resulting mixture of catalyst and hydrocarbon vapor passes upward through transfer line reactor 3. The feedstock undergoes catalytic cracking during passage through transfer line reactor 3, and the resulting mixture of catalyst and hydrocarbons is discharged into reactor vessel 4 through downward directed discharge head 5. The upper surface 6 of the dense phase of catalyst particles within vessel 4 is generally maintained below discharge head 5, thereby allowing hydrocarbon vapors to disengage from the catalyst particles without substantial contact with the dense phase. However, if desired, the location of catalyst phase interface 6 may be varied from a position below discharge head 5 to a position from discharge head 5. In the latter case, increased catalytic conversion of the feedstock will occur as a consequence of additional cracking taking place within the dense phase of catalyst in reactor vessel 4.

Vapors and entrained catalyst particles passing upward through reactor vessel 4 enter primary cyclone separator 7. Most of the entrained catalyst particles are separated in the first stage cyclone 7 and are discharged downwardly through dip-leg 8 and into the dense phase bed of catalyst within reactor vessel 4. Vapors and remaining catalyst particles are passed through interstage cyclone line 9 to second stage cyclone separator 10 where substantially all of the remaining catalyst is separated and passed downwardly through dip-leg 11 and into the dense phase bed of catalyst within reactor vessel 4.

Effluent vapors pass from cyclone 10, through line 12, into plenum chamber 13, and are discharged through line 14. Line 14 conveys the effluent vapors to a product recovery zone, not shown, wherein the vapors are separated into product fractions by methods which are well known in the art.

Deactivated catalyst particles from the dense phase bed in the lower portion of reactor vessel 4, which carry sulfur-containing coke deposits, pass downwardly into stripping zone 15. Baffles 16 are situated in stripping zone 15, and a mixture of air and steam from line 17 is discharged through distribution ring 18 into the lower portion of stripping zone 15. The amount of oxygen discharged into stripping zone 15 in the form of air is about 15 percent of the stoichiometric amount required to completely convert the coke deposits to carbon dioxide, steam and sulfur dioxide. The air and steam react with the sulfur-containing coke deposits in stripping zone 15 and the resulting upward flowing gasification products strip volatile material and entrained hydrocarbon vapors from the deactivated catalyst as it enters and begins its downward passage through stripping zone 15. The upward flowing gases serve to fluidize the catalyst particles in stripping zone 15 and in the dense phase bed within reactor vessel 4.

Catalyst particles carrying modified coke deposits which have a reduced sulfur content are withdrawn from the bottom of stripping zone 15 through spent catalyst standpipe 19 at a rate controlled by valve 20, and discharge through line 21 into spent catalyst transfer line 22. Deactivated catalyst from line 21 is fluidized with air from line 23 and passes upwardly through transfer line 22 and into regulator vessel 24. Transfer line 22 terminates in a downwardly directed discharge head 25, and effluent from transfer line 22 is discharged below the surface 26 of the dense phase of fluidized catalyst particles in the regenerator vessel 24. Catalyst within the regenerator vessel 24 is fluidized by combustion air from line 27 which is discharged through air ring 28, whereupon the coke deposits on the catalyst are burned and the catalytic activity of the deactivated catalyst is restored. Combustion gases continuously pass upwardly from the dense catalyst phase into the dilute phase above the catalyst interface 26. These combustion gases, together with entrained catalyst particles, enter primary cyclone separator 29. Most of the entrained catalyst particles are separated in the first stage cyclone 29 and are discharged downwardly through dip-leg 30 and into the dense catalyst phase within regenerator vessel 24. Combustion gases and remaining catalyst particles are passed through interstage cyclone line 31 to second stage cyclone separator 32 where substantially all of the remaining catalyst is separated and passed downwardly through dip-leg 33 and into the dense catalyst phase within regenerator vessel 24. Effluent gases from cyclone separator 32 pass through line 34, into plenum 35, and are discharged through line 26. Effluent combustion gases from line 36 can be discharged directly to the atmosphere or, alternatively, can be passed through conventional particulate control equipment and conventional heat exchange means prior to such discharge into the atmosphere. If desired, the effluent gases can also be passed through an expander turbine prior to discharge into the atmosphere.

Regenerated catalyst having a low content of residual coke is withdrawn from the bottom of regenerator vessel 24 through standpipe 37 at a rate controlled by valve 38 to supply hot regenerated catalyst to line 2 which is described above. A recycle stream of hot regenerated catalyst is also withdrawn from regenerator vessel 24 through line 39 at a rate controlled by valve 40 and discharges through line 41 into stripping zone 15. The recycle stream of regenerated catalyst is passed into stripping zone 15 from line 41 at a rate sufficient to maintain the temperature in stripping zone 15 within the range from about 550° to about 700° C. and to provide a recycle ratio of hot regenerated catalyst to deactivated catalyst within the range from about 0.05 to about 1.0.

Conversion of a selected hydrocarbon feedstock in a fluidized catalytic cracking process is effected by contact with a cracking catalyst, preferably in one or more fluidized transfer line reactors, at conversion temperature and at a fluidizing velocity which limits the conversion time to not more than about ten seconds. Conversion temperatures are desirably in the range from about 450° to about 565° C., and preferably from about 450° to about 540° C.

In the usual case where a gas oil feedstock is employed in a conventional fluidized catalytic cracking process, the throughput ratio (TPR), or volume ratio of total feed to fresh feed, can vary from about 1.0 to about 3.0. Conversion level can vary from about 40% to about 100% where conversion is here defined as the percentage reduction of hydrocarbons boiling above 221° C. at atmospheric pressure by formation of lighter materials or coke. The weight ratio of catalyst to oil in the reactor can vary within the range from about 2 to about 25 so that the fluidized dispersion will have a density in the range from about 16 to about 320 kilograms per cubic meter. Fluidizing velocity can be in the range from about 3.0 to about 30 meters per second, and the cracking process is preferably effected in a transfer line reactor wherein the ratio of length to average diameter is at least about 25.

In a fluidized catalytic cracking process catalyst regeneration is accomplished by burning the coke deposits from the catalyst surfaces in a regeneration zone with an oxygen-containing gas such as air. Deactivated cracking catalyst typically contains from about 0.5 to about 3 weight percent coke and regenerated catalyst desirably contains less than about 0.3, preferably less than about 0.2 and most preferably less than about 0.1 weight percent of residual coke. Any conventional regeneration technique can be employed, including that which is set forth in U.S. Pat. No. 3,909,392 to Horecky et al. The regeneration zone temperatures are ordinarily in the range from about 565° C. to about 815° C. and are preferably in the range from about 620° to about 735° C. When air is used as the regeneration gas, it enters the regenerator from a blower or compressor and a fluidizing velocity in the range from about 0.05 to about 8.0 meters per second, preferably from about 0.05 to about 1.5 meters per second and more preferably from about 0.15 to about 1.0 meters per second is maintained in the regenerator. Regenerated catalyst is then recycled to the transfer line reactor for further use in the conversion of hydrocarbon feedstock.

A suitable hydrocarbon feedstock for use in a fluidized catalytic cracking process in accordance with this invention can contain from about 0.05 to about 10 percent of sulfur in the form of organic sulfur compounds. Advantageously, the feedstock contains from about 0.1 to about 6 weight percent sulfur and more advantageously contains from about 0.2 to about 4 weight percent sulfur wherein the sulfur is present in the form of organic sulfur compounds. Suitable feedstocks include, but are not limited to, sulfur-containing petroleum fractions such as light gas oils, heavy gas oils, wide-cut gas oils, vacuum gas oils, naphthas, decanted oils, residual fractions and cycle oils derived from any of these as well as sulfur-containing hydrocarbon fractions derived from shale oils, tar sands processing, synthetic oils, coal liquefaction and the like. Any of these suitable feedstocks can be employed either singly or in any desired combination.

Conventional hydrocarbon cracking catalysts include those of the amorphous silica-alumina type having an alumina content of about 10 to about 30 weight percent. Catalysts of the silica-magnesia type are also suitable which have a magnesia content of about 20 weight percent. Preferred catalysts include those of the zeolite-type which comprise from about 0.5 to about 50 weight percent and preferably from about 1 to about 30 weight percent of a crystalline alumino-silicate component distributed throughout a porous matrix. Zeolite-type cracking catalysts are preferred because of their thermal stability and high catalytic activity.

The crystalline aluminosilicate or zeolite component of the zeolite-type cracking catalyst can be of any type or combination of types, natural or synthetic, which is known to be useful in catalyzing the cracking of hydrocarbons. Suitable zeolites include both naturally occurring and synthetic aluminosilicate materials such as faujasite, chabazite, mordenite, Zeolite X (U.S. Pat. No. 2,882,244), Zeolite Y (U.S. Pat. No. 3,130,007) and ultrastable large-pore zeolites (U.S. Pat. Nos. 3,293,192 and 3,449,070). The crystalline aluminosilicates having a faujasite-type crystal structure are particularly suitable and include natural faujasite, Zeolite X and Zeolite Y. These zeolites are usually prepared or occur naturally in the sodium form. The presence of this sodium is undesirable, however, since the sodium zeolites have a low catalytic activity and also a low stability at elevated temperatures in the presence of steam. Consequently, the sodium content of the zeolite is ordinarily reduced to the smallest possible value, generally less than about 1.0 weight percent and preferably below about 0.3 weight percent through ion exchange with hydrogen ions, hydrogen-precursors such as ammonium ion, or polyvalent metal cations including calcium, magnesium, strontium, barium and the rare earth metals such as cerium, lanthanum, neodymium and their mixtures. Suitable zeolites are also able to maintain their pore structure under the high temperature conditions of catalyst manufacture, hydrocarbon processing and catalyst regeneration. These materials have a uniform pore structure of exceedingly small size, the cross section diameter of the pores being in the range from about 4 to about 20 angstroms, preferably from about 8 to about 15 angstroms.

The matrix of the zeolite-type cracking catalyst is a porous refractory material within which the zeolite component is dispersed. Suitable matrix materials can be either synthetic or naturally occurring and include, but are not limited to, silica, alumina, magnesia, boria, bauxite, titania, natural and treated clays, kieselguhr, diatomaceous earth, kaolin and mullite. Mixtures of two or more of these materials are also suitable. Particularly suitable matrix materials comprise mixtures of silica and alumina, mixtures of silica with alumina and magnesia, and also mixtures of silica and alumina in combination with natural clays and clay-like materials. Mixtures of silica and alumina are preferred, however, and contain preferably from about 10 to about 65 weight percent of alumina mixed with from about 35 to about 90 weight percent of silica.

The following examples are intended only to illustrate the invention and are not to be construed as imposing limitations on the invention.

EXAMPLE 1

A 200 gram sample of particulate silica-alumina cracking catalyst which was deactivated by sulfur-containing coke deposits was placed in a test vessel surrounded by a furnace to provide the desired experimental temperature. The coked catalyst sample was fluidized by a flow of nitrogen which was passed through the fixed fluidized bed of catalyst at a rate of 800 cc./min. during the period of time required to heat the catalyst sample to a temperature of 649° C. The flow of nitrogen was then terminated, and a mixture of air and steam was passed through the fixed fluidized bed at 649° C. for 15 minutes at a rate of 800 cc./min. of air and 0.05 g/min. of water (corresponding to a mole ratio of steam to oxygen of 0.4/1). The data which are set forth in the following Table demonstrate that the initial coke deposit was modified in such a manner that 7 percent of the carbon, 30 percent of the sulfur, and 42 percent of the hydrogen were removed as gases. With respect to the sulfur removed, 62 percent was discharged in the effluent gas from the test vessel as hydrogen sulfide and the remainder was discharged as sulfur dioxide. These test results serve to illustrate the selective removal of the sulfur and hydrogen content of coke deposits on deactivated cracking catalyst upon reaction with a mixture of air and steam. The results further demonstrate that large quantities of the sulfur can be removed in the form of hydrogen sulfide.

TABLE

| | Start of Test | End of Test |
|---|---|---|
| Carbon on catalyst, wt. % | 1.347 | 1.250 |
| Hydrogen on catalyst, wt. % | 0.153 | 0.089 |
| Sulfur on catalyst, wt. % | 0.0779 | 0.0544 |
| $SO_2$ produced, grams | — | 0.0171[a] |
| $H_2S$ produced, grams | — | 0.0280[b] |

[a]All of the $SO_2$ was produced during fluidization of the sample with steam and air.
[b]0.0128 grams of the hydrogen sulfide (46%) was produced during fluidization of the coked catalyst sample with nitrogen prior to contacting with steam and air.

EXAMPLE 2

Figure 2:
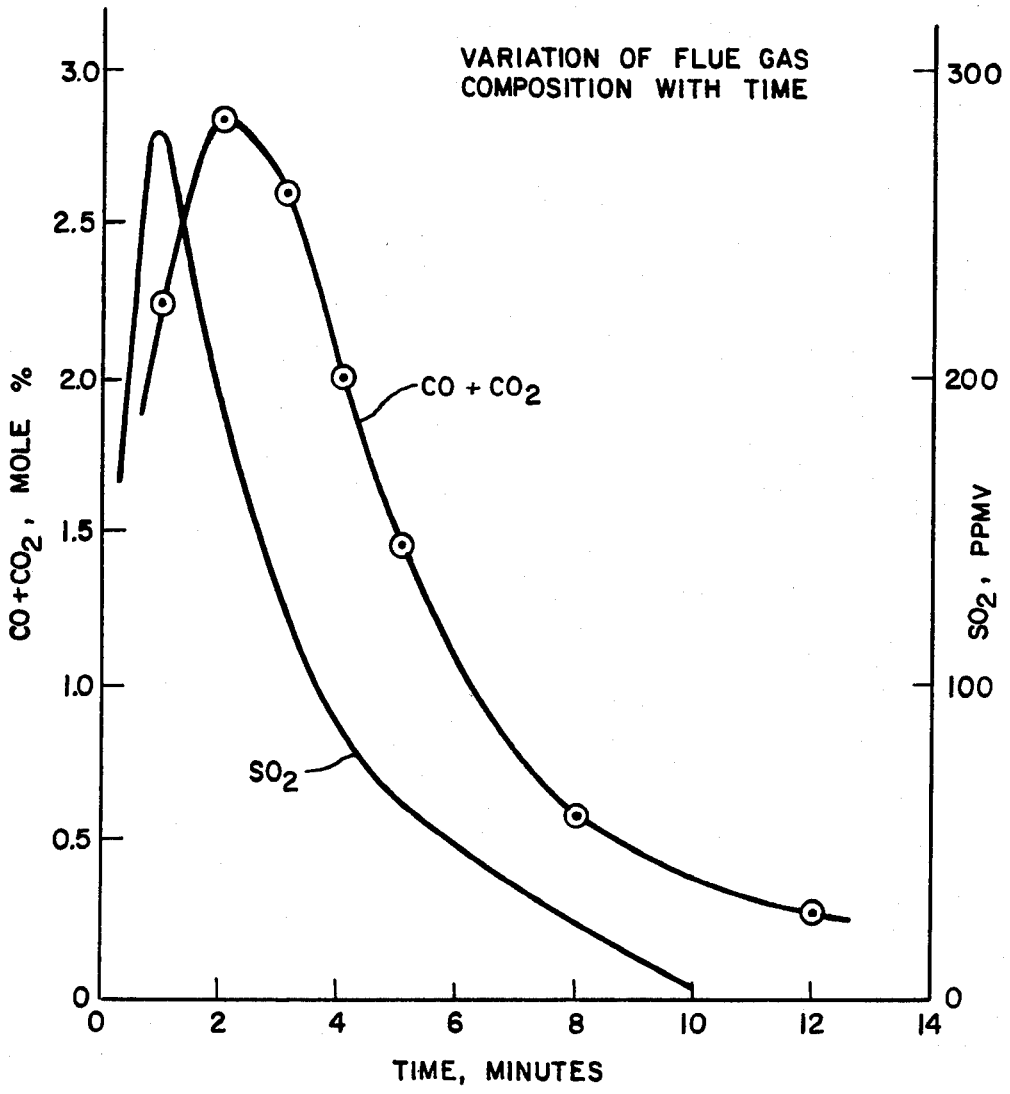
FIG. 2 of the drawings illustrates the variation with time of the effluent gas composition when a sample of coked cracking catalyst is contacted at 649° C. with a gas containing 4 mole percent oxygen.

At a temperature of 649° C., a gas mixture composed of 4 mole percent oxygen and 96 mole percent nitrogen was passed at a rate of 1000 cc./min. through a 10 gram sample of HFZ-20 particulate cracking catalyst (marketed by the Houdry Division of Air Products and Chemicals, Inc.) which was deactivated with sulfur-containing coke deposits. Effluent gas was passed through an $SO_2$ analyzer and, in addition, samples were periodically collected and analyzed for CO and $CO_2$ content by gas chromatography. These analytical results are shown in FIG. 2, which illustrates the variation of effluent gas composition with time. The results in FIG. 2 indicate that the sulfur content of coke is removed at a faster rate than the carbon content.

We claim:

1. A process for the fluidized catalytic cracking of a hydrocarbon feedstock containing organic sulfur compounds which comprises:

(a) cracking said feedstock in a reaction zone through contact with a particulate cracking catalyst;

(b) separating cracking products from cracking catalyst which is deactivated by sulfur containing coke deposits and passing said deactivated cracking catalyst to a stripping zone;

(c) contacting the deactivated cracking catalyst with an oxygen-containing gas in said stripping zone at a temperature in the range from about 550° to about 700° C. and reacting the oxygen with said sulfur-containing coke deposits to form products which include sulfur-containing gases, wherein the amount of oxygen introduced into said stripping zone is effective to remove at least about 10 weight percent of the sulfur content and less than about 30 weight percent of the carbon content of said sulfur-containing coke deposits, and wherein said weight percent of the sulfur content removed is greater than said weight percent of the carbon content removed;

(d) withdrawing an effluent gas from the stripping zone and combining said stripping zone effluent gas with said cracking products;

(e) withdrawing from the stripping zone cracking catalyst which is deactivated by modified coke deposits having a reduced sulfur content and passing said catalyst from the stripping zone to a regeneration zone;

(f) removing said modified coke deposits from the deactivated cracking catalyst in said regeneration zone by burning with an oxygen-containing regeneration gas, thereby regenerating and heating the cracking catalyst;

(g) recycling a stream of hot regenerated cracking catalyst from the regeneration zone to the stripping zone in an amount which is effective to maintain the temperature in said stripping zone within the range from about 550° to about 700° C. and to provide a recycle ratio of hot regenerated cracking catalyst to deactivated cracking catalyst within the range from about 0.05 to about 1.0; and (h) withdrawing a stream of regenerated cracking catalyst from the regeneration zone and passing said regenerated cracking catalyst to the reaction zone.

2. The process as set forth in claim 1 wherein the amount of oxygen introduced into said stripping zone is effective to remove at least about 30 weight percent of the sulfur content of said sulfur-containing carbonaceous deposits.

3. The process as set forth in claim 1 wherein steam is additionally introduced into said stripping zone.

4. The process as set forth in claim 3 wherein the mole ratio of steam to oxygen employed in said stripping zone is from about 0.1/1 to about 5/1.

5. The process as set forth in claim 1 wherein the oxygen-containing gas employed in said stripping zone is air.

6. The process as set forth in claim 1 wherein said oxygen-containing gas employed in said stripping zone is substantially pure molecular oxygen.

7. The process as set forth in claim 1 wherein the amount of oxygen introduced into said stripping zone is less than about 23 percent of the stoichiometric amount of oxygen required to completely convert the coke to carbon dioxide, steam and sulfur dioxide.

8. The process as set forth in claim 1 wherein the amount of oxygen introduced into said stripping zone is effective to remove at least about 10 weight percent of the sulfur content and less than about 10 weight percent of the carbon content of said sulfur-containing coke deposits.

9. The process as set forth in claim 1 wherein the temperature in said stripping zone is at least about 30° C. higher than that in said reaction zone.

10. A process for the fluidized catalytic cracking of a hydrocarbon feedstock containing organic sulfur compounds which comprises:

(a) cracking said feedstock in a reaction zone through contact with a particulate cracking catalyst;

(b) separating cracking products from cracking catalyst which is deactivated by sulfur-containing coke deposits and passing said deactivated cracking catalyst to a stripping zone;

(c) contacting the deactivated cracking catalyst with an oxygen-containing gas in said stripping zone at a temperature in the range from about 550° to about 700° C. and reacting the oxygen with said sulfur-containing coke deposits to form products which include sulfur-containing gases, wherein the amount of oxygen introduced into said stripping zone is effective to remove at least about 10 weight percent of the sulfur content and less than about 30 weight percent of the carbon content of said sulfur-containing coke deposits, and wherein said weight percent of the sulfur content removed is greater than said weight percent of the carbon content removed;

(d) withdrawing an effluent gas from the stripping zone and combining said stripping zone effluent gas with said cracking products;

(e) withdrawing from the stripping zone cracking catalyst which is deactivated by modified coke deposits having a reduced sulfur content and passing said catalyst from the stripping zone to a regeneration zone;

(f) removing said modified coke deposits from the deactivated cracking catalyst in said regeneration zone by burning with an oxygen-containing regeneration gas, thereby regenerating and heating the cracking catalyst;

(g) recycling a stream of hot regenerated cracking catalyst from the regeneration zone to the stripping zone in an amount which is effective to maintain the temperature in said stripping zone within the range from about 550° C. and to provide a recycle ratio of hot regenerated cracking catalyst to deactivated cracking catalyst within the range from about 0.05 to about 1.0;

(h) withdrawing a stream of regenerated cracking catalyst from the regeneration zone and passing said regenerated cracking catalyst to the reaction zone; and (i) circulating a water-gas shift catalyst through the catalytic cracking process with said cracking catalyst.

11. The process as set forth in claim 10 wherein steam is additionally introduced into said stripping zone.

* * * * *

UNITED STATES PATENT OFFICE
CERTIFICATE OF CORRECTION

Patent No. 4,440,632 Dated April 3, 1984

Inventor(s) IACOVOS A. VASALOS and EUGENE G. WOLLASTON

It is certified that error appears in the above-identified patent and that said Letters Patent are hereby corrected as shown below:

Column 1, lines 36-37, After "particles" add --,--.

Column 9, line 64, "metal of metals" should be --metal or metals--.

Column 10, line 48, "from" should be --above--.

Column 11, line 29, "regulator" should be --regenerator--.

Column 11, line 53, "26" should be --36--.

Column 12, lines 59-60, "10 percent" should be --10 weight percent--.

Column 14, line 68, "sulfur containing" should be --sulfur-containing--.

Column 16, line 50, After "550°C." add --to about 700°C.--.

Signed and Sealed this

Eighteenth Day of December 1984

[SEAL]

*Attest:*

*Attesting Officer*

GERALD J. MOSSINGHOFF

*Commissioner of Patents and Trademarks*